US008212477B2

(12) United States Patent
Murakoso et al.

(10) Patent No.: US 8,212,477 B2
(45) Date of Patent: Jul. 3, 2012

(54) PLASMA DISPLAY PANEL

(75) Inventors: Tomohiro Murakoso, Hyogo (JP); Kenji Ogawa, Osaka (JP); Toru Ando, Osaka (JP); Kentaro Ueda, Osaka (JP); Yohei Koshio, Osaka (JP); Ryuichi Murai, Osaka (JP)

(73) Assignee: Panasonic Corporation, Osaka (JP)

( * ) Notice: Subject to any disclaimer, the term of this patent is extended or adjusted under 35 U.S.C. 154(b) by 780 days.

(21) Appl. No.: 10/594,161

(22) PCT Filed: Apr. 12, 2006

(86) PCT No.: PCT/JP2006/307703

§ 371 (c)(1),
(2), (4) Date: Sep. 26, 2006

(87) PCT Pub. No.: WO2006/112310

PCT Pub. Date: Oct. 26, 2006

(65) Prior Publication Data

US 2008/0272696 A1 Nov. 6, 2008

(30) Foreign Application Priority Data

Apr. 14, 2005 (JP) ..... 2005-116893

(51) Int. Cl.
*H01J 17/49* (2012.01)

(52) U.S. Cl. ..... 313/582; 313/583; 345/30

(58) Field of Classification Search ..... 313/582–587; 315/169.3, 169.4; 345/60, 30, 37; 445/24–25
See application file for complete search history.

(56) References Cited

U.S. PATENT DOCUMENTS

| | | | | |
|---|---|---|---|---|
| 6,285,128 | B1 * | 9/2001 | Amemiya | 313/582 |
| 6,479,932 | B1 | 11/2002 | Nunomura | |
| 2005/0052137 | A1 * | 3/2005 | Kwon et al. | 313/584 |
| 2005/0067964 | A1 * | 3/2005 | Kim et al. | 313/584 |

FOREIGN PATENT DOCUMENTS

| | | | |
|---|---|---|---|
| JP | 6-44907 | A | 2/1994 |
| JP | 2000-100338 | A | 4/2000 |
| JP | 2003-308783 | A | 10/2003 |
| JP | 2005-91555 | A | 4/2005 |

OTHER PUBLICATIONS

Japanese language International Search Report for PCT/JP2006/307703, dated May 16, 2006.

* cited by examiner

*Primary Examiner* — Joseph L Williams
*Assistant Examiner* — Elmito Breval
(74) *Attorney, Agent, or Firm* — RatnerPrestia

(57) ABSTRACT

A plasma display panel has a first substrate, plural pairs of display electrodes, a second substrate, and plural data electrodes. Each pair of the display electrodes is made up of a scanning electrode and a sustain electrode which are arranged parallel to each other on the first substrate. The second substrate is disposed opposite to the first substrate. A discharge space is formed between the first substrate and second substrate. The data electrodes are arranged in a direction perpendicular to the display electrodes on the second substrate. The data electrode is wider in peripheral portion of the second substrate than in a central portion of the second substrate.

3 Claims, 7 Drawing Sheets

PLASMA DISPLAY PANEL

THIS APPLICATION IS A U.S. NATIONAL PHASE APPLICATION OF PCT INTERNATIONAL APPLICATION PCT/JP2006/307703.

TECHNICAL FIELD

The present invention relates to a plasma display panel for use in a large-sized display device or the like.

BACKGROUND ART

An AC plane discharge panel that typifies a plasma display panel (hereinafter abbreviated as "PDP") has a front plate and a back plate disposed opposite to each other. A number of discharge cells are formed between the front and back plates. Display electrodes, each consisting a pair of electrodes (i.e., a scanning electrode and a sustain electrode), are formed on a front glass substrate in plural pairs and parallel to each other in the front plate. A dielectric layer and a protective layer are formed over the display electrodes. The back plate has a back glass substrate on which plural parallel data electrodes are formed. A dielectric layer is formed over the data electrodes. Plural barrier ribs are formed on the dielectric layer in parallel to the data electrodes. A phosphor layer is formed on each of the surface of the dielectric layer and the side surfaces of the barrier ribs. The front and back plates are disposed opposite to each other and sealed such that the display electrodes and data electrodes intersect each other in three dimensions. A discharge gas is sealed in the internal discharge space. The discharge cells are formed in the portions in which the display electrodes and data electrodes are opposite to each other. In the PDP constructed in this way, electric discharging is induced within the gas in each discharge cell, so that ultraviolet rays are produced. The ultraviolet rays excite phosphors of colors of R, G, and B to emit light, thus providing a color display.

Generally, the subfield method is available to drive a PDP. In this method, one field period is divided into plural subfields. Gray levels are represented by combinations of emitted subfields. Each subfield has an initializing period, a writing period, and a sustaining period. During the initializing period, electric discharging is done for initialization within the discharge cell. This erases the previous history of wall charges at individual discharge cells. Also, wall charges necessary for a subsequent writing operation are formed. During the writing period, scanning pulses are successively applied to scanning electrodes. Writing pulses corresponding to an image signal to be displayed are applied to data electrodes. Thus, writing discharging occurs selectively between the scanning electrodes and data electrodes, thus selectively forming wall charges. During the sustaining period, a given number of sustaining pulses corresponding to brightness weights are applied between the scanning electrodes and sustain electrodes. Electric discharging occurs selectively within the discharge cells at which wall charges are created by writing discharging. Therefore, the discharge cells emit light.

In order to display an image correctly, it is important to perform selective writing discharging reliably during each writing period. However, the writing discharging involves many unstable factors. One of the factors is that the discharging is easily affected by the dimensional accuracy of the electrodes. Another factor is that the phosphor layers formed on data electrodes hinder discharging. In view of these problems, Japanese Patent Unexamined Publication No. 2000-100338 discloses a PDP having data electrodes whose shape are devised to permit writing operations to be performed in a short time reliably, thus reducing power consumption.

PDPs have been fabricated in ever increasing size. At the same time, PDPs have had higher definitions. It has become more difficult to fabricate discharge cells accurately over the whole surface of such a PDP. Meanwhile, application of the shape of data electrodes relying on the aforementioned related art technique makes electric discharging stable without being greatly affected by the dimensional accuracy of the electrodes. However, the application of the shape of the data electrodes increases the power consumption. If the shape of the data electrodes is designed in such a way that the power consumption is not increased, electric discharging is affected by the dimensional accuracy of the electrodes and thus is unstable. With the shape of the data electrode relying on the related art technique in this way, it is difficult to accomplish both stability of electric discharging and suppression of power consumption.

DISCLOSURE OF THE INVENTION

The present invention is intended to provide a PDP which is large in size and has high definition but permits stable writing electric discharging over the whole surface of the display screen while suppressing increases in power consumption. A PDP according to the present invention has a first substrate, plural pairs of display electrodes, a second substrate, and plural data electrodes. The display electrodes are made up of scanning electrodes and sustain electrodes arranged parallel to each other on the first substrate. The second substrate is disposed opposite to the first substrate. A discharge space is formed between the first substrate and second substrate. The data electrodes are arranged on the second substrate in a direction perpendicular to the display electrodes. The data electrodes are wider in peripheral portions of the second substrate than in a central portion of the second substrate. Because of this configuration, even when a PDP is large in size and has high definition, it can suppress increases in power consumption. As a result, the PDP permitting stable writing electric discharging over the whole display screen can be obtained.

DETAILED DESCRIPTION OF PREFERRED EMBODIMENTS

Embodiment 1

Figure 1:
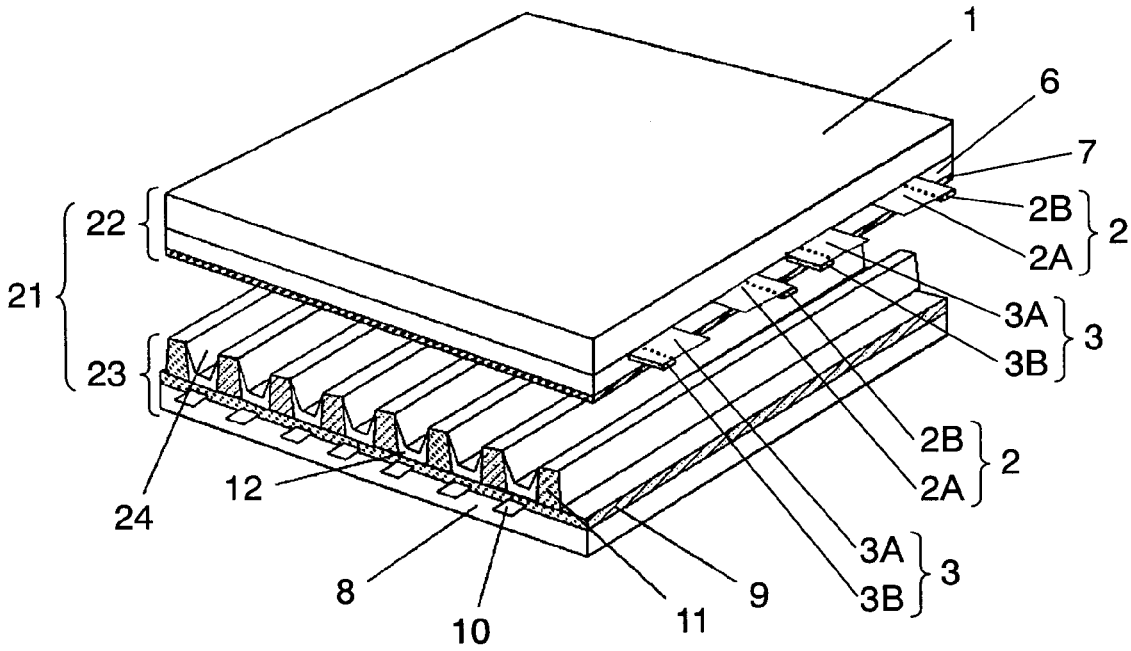
FIG. 1 is an exploded perspective view showing a structure of a plasma display panel (PDP) according to embodiment 1 of the present invention.

FIG. 1 is an exploded perspective view showing a structure of a plasma display panel according to the embodiment 1 of the present invention. Transparent electrodes 2A forming scanning electrodes 2 acting as display electrodes and transparent electrodes 3A forming sustain electrodes 3 are formed on front glass substrate (hereinafter referred to as "substrate") 1 that is a first substrate. Auxiliary electrodes 2B and 3B are formed on electrodes 2A and 3A, respectively. That is, each scanning electrode 2 is made up of transparent electrode 2A and auxiliary electrode 2B. Each sustain electrode 3 is made up of transparent electrode 3A and auxiliary electrode 3B. Scanning electrodes 2 and sustain electrodes 3 are formed substantially parallel to each other and alternately.

Dielectric layer 6 is formed over substrate 1 so as to cover transparent electrodes 2A, 3A and auxiliary electrodes 2B, 3B. Dielectric layer 6 can be formed, for example, by applying glass paste by a die coating method and then sintering the paste. Protective layer 7 is formed on dielectric layer 6. Protective layer 7 can be formed, for example, from magnesium oxide using a film deposition process such as a vacuum evaporation method. In this way, front plate 22 is fabricated by forming scanning electrode 2, sustain electrode 3, dielectric layer 6, and protective layer 7 in succession on substrate 1.

Stripes of plural data electrodes 10 are formed on back glass substrate (hereinafter referred to as "substrate") 8 that is a second substrate. The shape of data electrodes 10 will be described in detail later. Data electrodes 10 can be formed, for example, by applying photosensitive silver (Ag) paste by screen printing or other method, then patterning the paste by a photolithographic process, and sintering the paste. Dielectric base layer (hereinafter referred to as "dielectric layer") 9 is formed so as to cover data electrodes 10. Dielectric layer 9 can be formed, for example, by applying glass paste by screen printing and then sintering the paste.

Barrier ribs 11 are formed in stripes or mesh on dielectric layer 9. Barrier ribs 11 can be fabricated, for example, using a photosensitive paste consisting of an aggregate (such as $Al_2O_3$) and a chief material made of glass frit. That is, the barrier rib can be formed from such photosensitive paste by screen printing, die coating, or other method, patterning the film by a photolithographic process, and sintering the film. Alternatively, the pattern wall may also be formed by applying a paste including glass material repetitively at a given pitch by screen printing or other method and then sintering the paste.

Phosphor layers 12 emitting red, green, and blue colors are formed in grooves between barrier ribs 11. Phosphor layers 12 can be formed, for example, by applying a phosphor ink including phosphor particles and an organic binder and then sintering the ink. In this way, back plate 23 is fabricated by forming data electrode 10, dielectric layer 9, barrier ribs 11, and phosphor layers 12 in succession on substrate 8.

Back plate 23 and front plate 22 are sealed by applying low-melting-point glass frit to the peripheries of back plate 23, drying the frit, placing back plate 23 and front plate 22 opposite to each other, and heating the frit. Discharge space 24 between front plate 22 and back plate 23 is evacuated to a high vacuum and then a discharging gas such as neon or xenon is sealed in, thus completing plasma display panel (hereinafter abbreviated as "PDP") 21.

Figure 2:
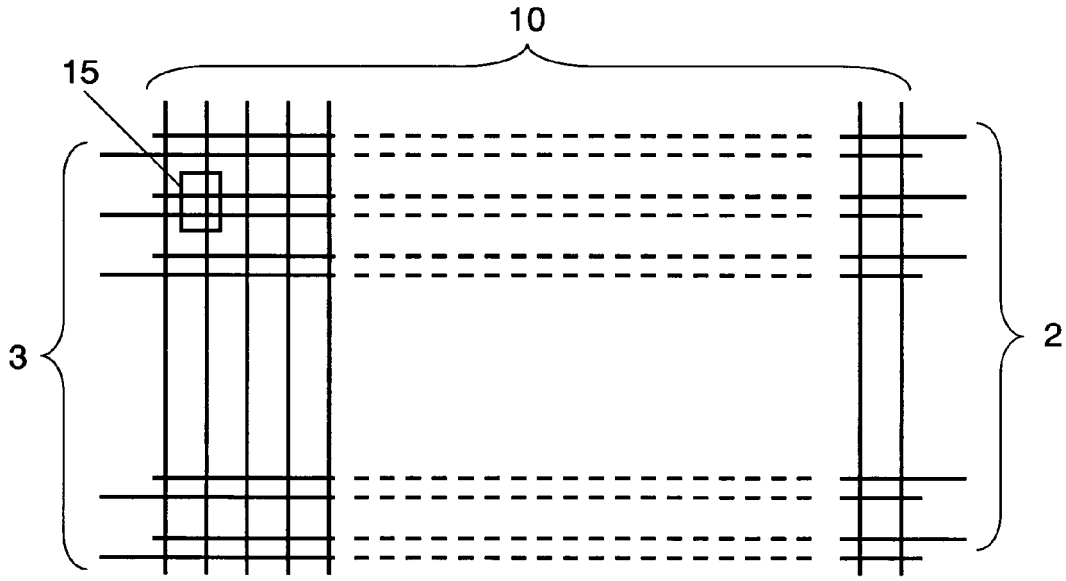
FIG. 2 is a diagram of an electrode array of the PDP shown in FIG. 1.

FIG. 2 is a diagram showing the array of electrodes of PDP 21. Data electrodes 10 are arranged in m columns in the column direction. Scanning electrodes 2 inn rows and sustain electrodes 3 in n rows are alternately arranged in the row direction. M×n discharge cells 15 each including a pair of electrodes (scanning electrode 2 and sustain electrode 3) and one data electrode 10 are formed inside discharge space 24. For example, where PDP 21 is a 50-inch wide panel of 1366×768 pixels, m=1366×3 and n=768.

A driving waveform for driving PDP 21 and its timing are next described. In the present embodiment, it is assumed that 1 field period consists of plural subfields each having an initializing period, a writing period, and a sustaining period. The subfields may be otherwise organized.

Figure 3:
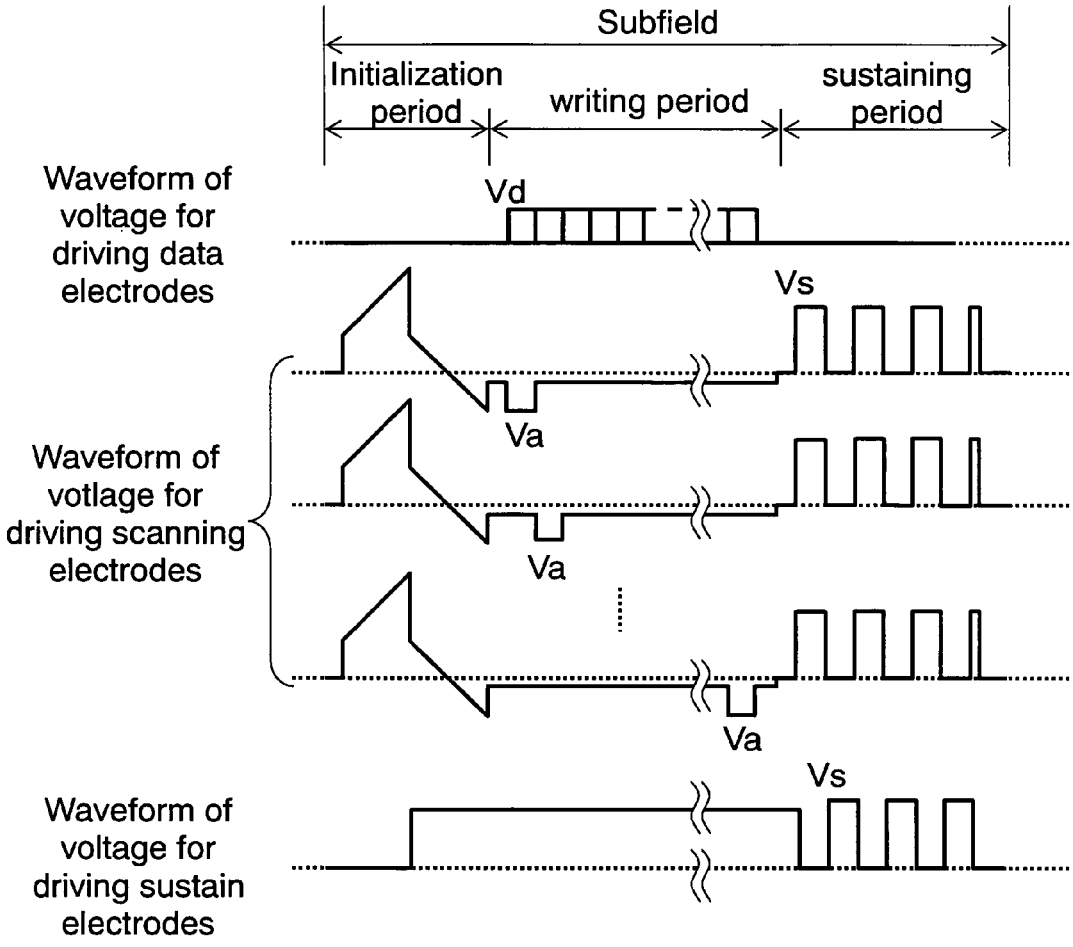
FIG. 3 is a waveform diagram of a driving voltage applied to each electrode of the PDP shown in FIG. 1.

FIG. 3 is a waveform diagram of the driving voltage applied to each electrode of PDP 21. During the initializing period, data electrodes 10 and sustain electrodes 3 are held at ground potential. A ramp waveform voltage increasing gently is applied to scanning electrodes 2. Then, sustain electrodes 3 are maintained at a positive voltage. A ramp waveform decreasing gently is applied to scanning electrodes 2. During this period, feeble initialization discharging occurs twice in each discharge cell 15. This weakens wall voltage on each scanning electrode 2 and wall voltage on each sustain electrode 3. Positive wall voltage Vw adapted for a writing operation is accumulated on data electrodes 10. The wall voltages on the electrodes are voltages produced by wall charges accumulated on dielectric layers 6, 9 covering the electrodes and on phosphor layer 12. This annihilates the previous history of the wall voltages on each individual discharge cell 15. The initialization operation for creating the wall voltage necessary for subsequent writing discharging ends.

During the writing period, positive writing pulse voltage Vd is applied to data electrodes 10 corresponding to discharge cells 15 to be displayed. Also, negative scanning pulse voltage Va is applied to corresponding scanning electrodes 2. In discharge cells 15 to which writing pulse voltage Vd and scanning pulse voltage Va are simultaneously applied, a voltage difference is produced at the intersections of the upper portions of data electrodes 10 and the upper portions of scanning electrodes 2. The voltage difference is obtained by adding positive wall voltage Vw on the upper portions of data electrodes 10 to the sum of the absolute values of writing pulse voltage Vd and scanning pulse voltage Va. The discharge start voltage is exceeded. Electric discharging occurs between data electrodes 10 and scanning electrodes 2 and evolves into electric discharging between sustain electrodes 3 and scanning electrodes 2. As a result, positive wall voltage is accumulated on scanning electrodes 2. Negative wall voltage is accumulated on sustain electrodes 3 and on data electrodes 10. Meanwhile, no writing discharging occurs in discharge cells 15 to which writing pulse voltage Vd and scanning pulse voltage Va are not applied at the same time. This writing operation is performed for all discharge cells 15, thus ending the writing period.

During the sustaining period, positive sustaining pulse voltage Vs is applied to scanning electrodes 2 and sustain electrodes 3 alternately. Thus, the sustaining discharging operation is continually repeated a number of times corresponding to brightness weight of the subfield for discharge cells 15 in which writing discharging has occurred. On the other hands, no sustain discharging occurs in discharging cells 15 in which no writing discharging has occurred. Operations similar to the operations described so far are performed for other subfields. PDD 21 emits light so as to draw an image by the mechanism described thus far.

Figure 4A:
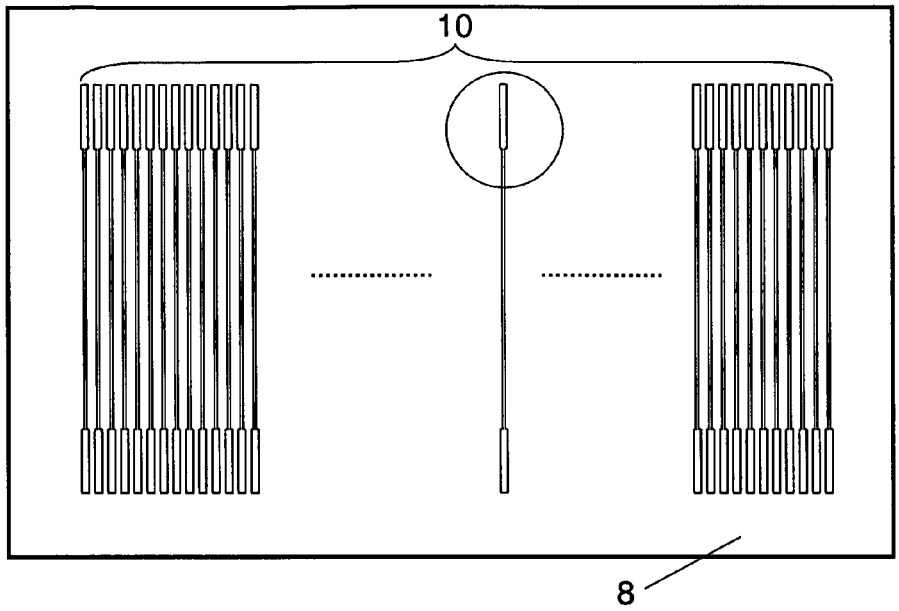
FIG. 4A is a plan view showing the shape of data electrodes of the PDP shown in FIG. 1.
Figure 4B:
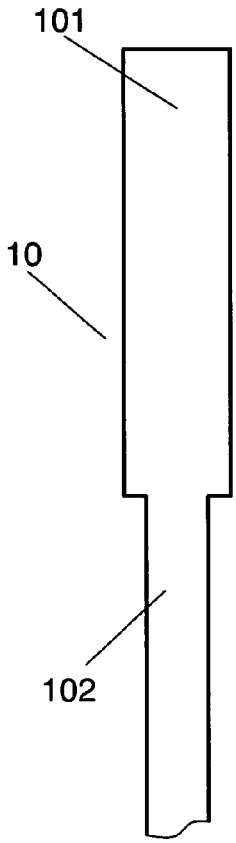
FIG. 4B is an enlarged view of one data electrode shown in FIG. 4A.

The shape of data electrodes 10 is next described in detail. FIG. 4A is a view showing data electrodes 10 formed like stripes on substrate 8. FIG. 4B is an enlarged view of a portion of data electrodes 10 of FIG. 4A which is surrounded by a circle. To facilitate understanding the figures, extension lines to the outside of substrate 8 from data electrodes 10 are omitted in FIGS. 4A and 4B.

As shown in FIGS. 4A and 4B, data electrodes 10 are wider in peripheral portions of substrate 8 than in a central portion of substrate 8. That is, end portions of data electrodes 10, i.e., data electrodes 10 in end portions 101 arranged at top and bottom of FIG. 4A, are wider than those in central portion 102. As a specific example shown in FIG. 4B, end portion 101 that is a portion of 30 mm including the top end of data electrode 10 and a portion of 30 mm including the bottom end thereof have a width of 130 μm. Central portion 102 has a width of 100 μm. The pitch between data electrodes 10 is about 270 μm. Writing discharging that is stable over the whole display screen is enabled by designing data electrodes 10 in this way.

Figure 4C:
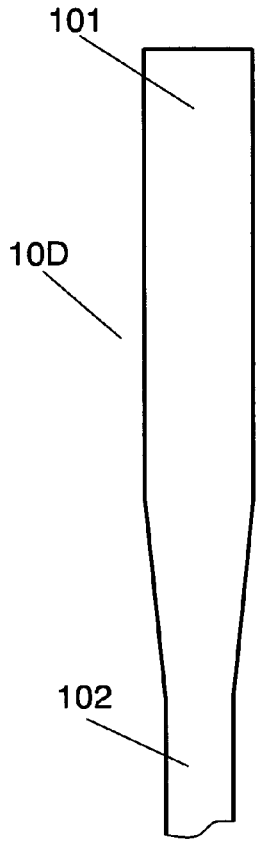
FIG. 4C is an enlarged view of another data electrode of the PDP according to the embodiment 1 of the present invention.

As shown in FIG. 4C, each data electrode 10D may be made wider continuously from the central portion of substrate 8 toward the peripheral portions of substrate 8. That is, the width of data electrode 10D continuously increases from central portion 102 disposed in the central portion of substrate 8 toward end portions 101 disposed in peripheral portions of substrate 8. If the width of data electrode 10D is varied continuously, the discharging characteristics of discharge cells 15 also vary continuously. In consequence, deterioration in quality by nonuniformity of the brightness or the like does not occur.

The reason why the writing discharging is stabilized by shaping data electrodes 10 and 10D as described so far is not fully understood. However, the following factors are conceivable.

A first conceivable factor is the effect of deviation of the positions of barrier ribs 11 relative to data electrodes 10 and 10D. As PDP 21 is increased in size and has higher definition, it becomes more difficult to form discharge cells 15 accurately over the whole surface of PDP 21. Especially, in peripheral portions of PDP 21, errors caused by elongation and shrinkage of masks and substrates 1, 8 and manufacturing errors such as errors caused by misalignment are accumulated. Therefore, the dimensional accuracy of discharge cells 15 in peripheral portions of PDP 21 deteriorates. Especially, where data electrodes 10 are narrow, if the positions of the barrier ribs relative to data electrodes 10 and 10D deviate, there is the possibility that the voltage applied to data electrodes 10 and 10D is not sufficiently transmitted into discharge space 24. As a result, there arises the possibility that writing discharging is not easily produced. Accordingly, if data electrodes 10 and 10D are made sufficiently wide, it is assured that the data voltage is transmitted into discharge space 24 even when the positions of barrier ribs 11 relative to data electrodes 10 and 10D have deviated. Consequently, stable writing discharging takes place.

A second conceivable factor is a drop of the wall voltage on data electrodes 10 and 10D. In peripheral portions of PDP 21, there is an increased possibility that a gap is created between discharge cells 15 due to variations in height of barrier ribs 11 and thickness variations of dielectric layers 6 and 9. During the initializing period, a wall voltage adapted for writing operation is accumulated on data electrodes 10 and 10D. If a gap exists between discharge cells 15, charged particles fly in from adjacent discharge cells 15, neutralizing the wall charge on data electrodes 10 and 10D. As a result, the wall voltage drops. For this reason, the voltage applied to discharge cells 15 becomes insufficient during writing discharging, so that there is the possibility that the writing discharging becomes unstable.

If the width of data electrodes 10 and 10D is made sufficiently large, the capacitances of data electrodes 10 and 10D increase and, therefore, a larger amount of electric charge is required to vary the wall voltage. In other words, in a case where the width of data electrodes 10 and 10D is made sufficiently large, even when charged particles fly into thereby neutralizing the wall charge on data electrodes 10 and 10D, decreases in the wall voltages are suppressed. Accordingly, the writing discharging is stabilized without shortage of the voltage applied to discharge cells 15 during the writing discharging. In this way, whatever factor is involved, the writing discharging can be stabilized by making data electrodes 10 and 10D wider.

Figure 5:
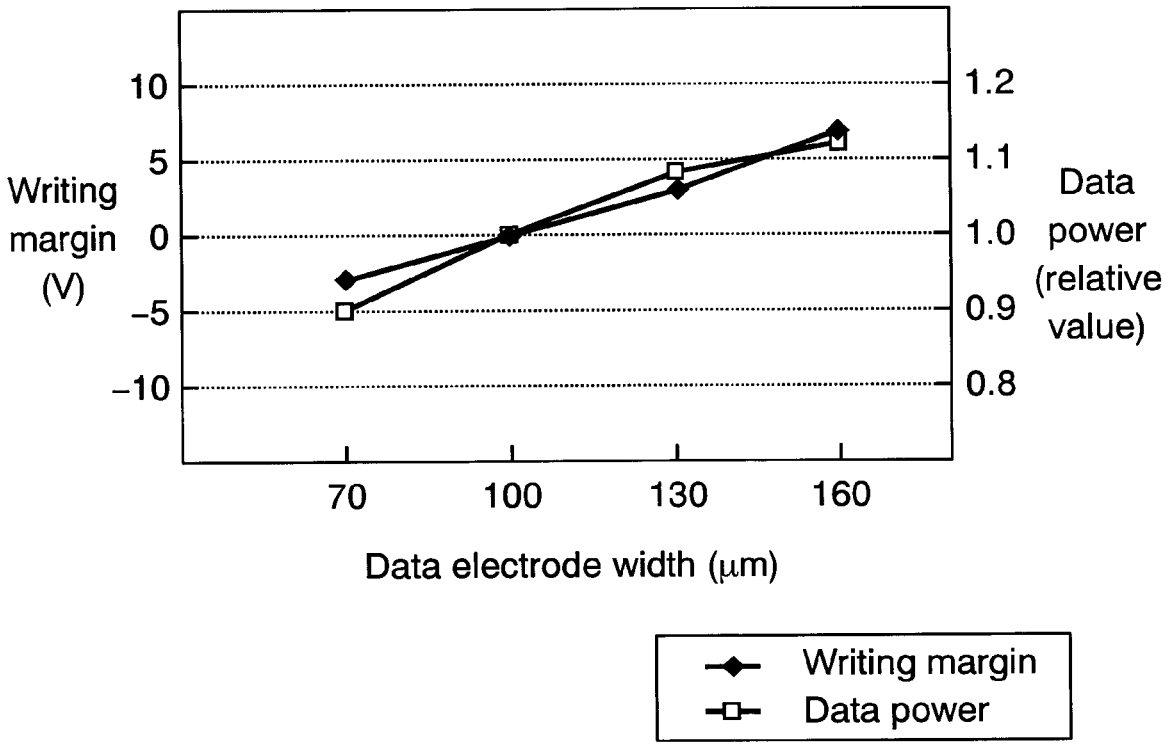
FIG. 5 is a correlation diagram of a width of data electrode of the PDP and writing margin.

FIG. 5 is a correlation diagram between the width of data electrodes 10 and the writing margin in a case where the width of data electrodes 10 has been uniformly increased over the whole surface of a 50-inch wide panel of 1366×768 pixels. The writing margin is an index of stability of writing discharging. FIG. 5 shows variation of the writing voltage when the width of data electrodes 10 is varied, relative to a writing voltage necessary to perform stable writing operation under the condition where the width of data electrodes 10 is 100 μm. FIG. 5 also shows variation of electric power (hereinafter referred to as "data power") for driving data electrodes 10 relative to the value obtained when the width of data electrodes 10 is 100 μm. It can be seen from FIG. 5 that the writing margin is increased by increasing the width of data electrodes 10. However, it can also be seen that increasing the width of data electrodes 10 increases the capacitance of data electrodes 10, so that the data power increases.

Meanwhile, discharge cells 15 in which the writing discharging becomes unstable are located only in peripheral regions of PDP 21, i.e., around the periphery of substrate 8 as described previously. When the magnitude of writing voltage margin in each region on the display screen of PDP 21 is measured in practice, it can be seen that the writing margin of discharge cells 15 in peripheral portions of PDP 21 is small. The writing margin increases with going toward the central portion of PDP 21. Accordingly, it is not necessary to increase the width of data electrodes 10 over the whole surface of PDP 21. Writing discharging is stabilized and increases in the data power can be suppressed by making wider data electrodes 10 in peripheral portions of PDP 21 and making narrower data electrodes 10 in the central portion of PDP 21. In the structure shown in FIG. 4A, increase in the data power can be suppressed to about 1% by limiting the widened regions of data electrodes 10 to upper and lower portions of data electrodes 10 of 30 mm.

Preferably, the width of end portion 101 is greater than the width of central portion 102 by a factor of more than 1.0 and not more than 1.5. Increase in the data power can be suppressed to on the order of several percent by setting the upper limit to a factor of 1.5. In the above-described specific embodiment, the ratio of the width is a factor of 1.3. Stabilization of writing discharging and suppression of increases in data power can be achieved with a good balance with more desirable results by setting the ratio of the width to a factor of 1.3 or more for the whole length of each data electrode 10 on substrate 8 in this way. Preferably, the width of end portion 101 is set to not more than a half of the spacing between barrier ribs 11. By setting the dimensions in this way, data electrodes 10 are reliably disposed between barrier ribs 11. The interval between barrier ribs 11 corresponds to the pitch between data electrodes 10.

Figure 6:
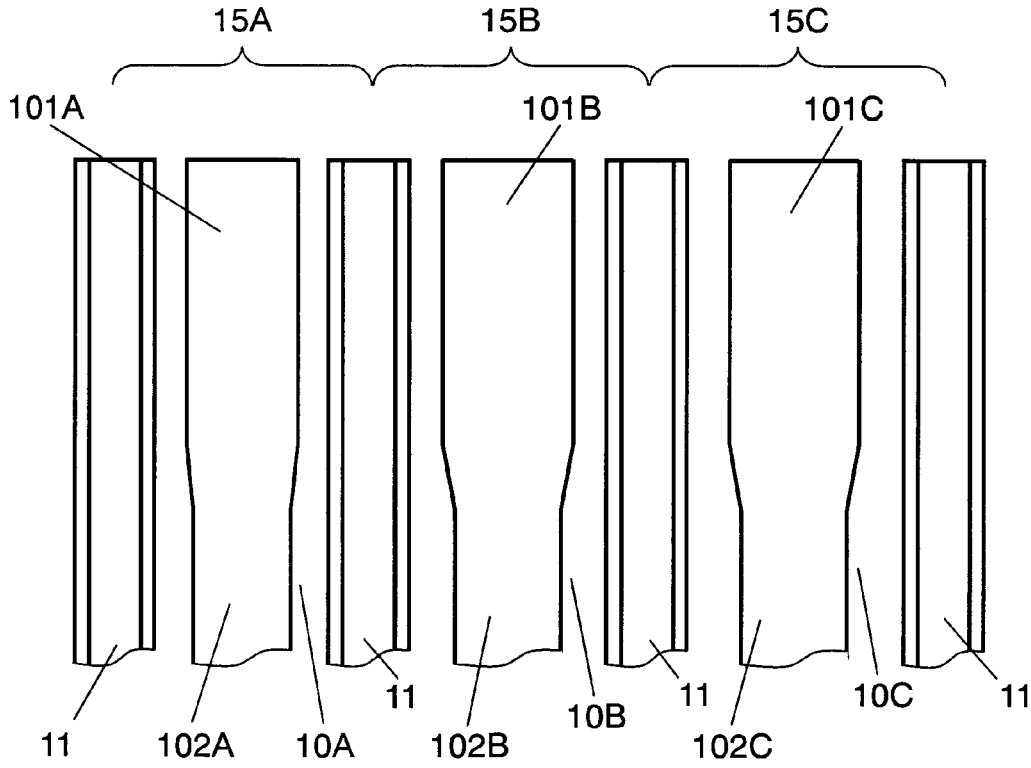
FIG. 6 shows other shapes of data electrodes of the PDP according to the embodiment 1 of the present invention.

In the description provided so far, it is assumed that the widths of discharge cells 15 for colors of red, green, and blue are all equal. The widths of discharge cells 15 may differ with different colors. FIG. 6 is a view showing the shape of data electrodes of another plasma display panel according to the present embodiment. For example, the width of discharge cells 15A for red color is 250 μm. The width of discharge cells 15B for green color is 270 μm. The width of discharge cells 15C for blue color is 290 μm. The widths of central portions 102A, 102B, and 102C of data electrodes 10A, 10B, and 10C corresponding to discharge cells 15A, 15B, and 15C, respectively, are 100 μm, for example. The widths of end portions 101A, 101B, and 101C that are portions of 30 mm including the upper ends of data electrodes 10A, 10B, and 10C and portions of 30 mm including the lower ends are 110 μm, 130 μm, and 130 pin, respectively. Stable writing discharging is enabled over the whole display screen by forming data electrodes 10A, 10B, and 10C in this way even when discharge cells 15A, 15B, and 15C differ in width with different colors.

Embodiment 2

Figure 7A:
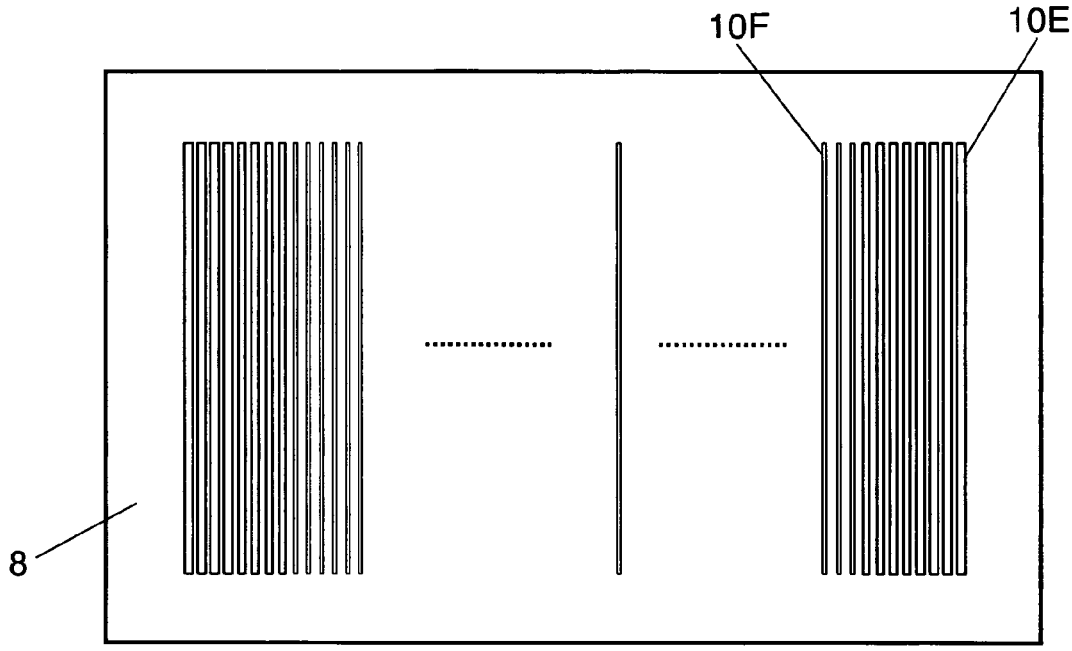
FIG. 7A is a plan view showing one shape of data electrodes of a PDP according to embodiment 2 of the present invention.

FIG. 7A is a plan view showing the shape of data electrodes of a plasma display panel according to embodiment 2 of the present invention. The great difference of the present embodiment with the embodiment 1 is that data electrodes arranged in peripheral portions of substrate 8 (plasma display panel) is wider than data electrodes arranged in the central portion of substrate 8. Since the embodiment 2 is similar to the embodiment 1 in other fundamental structures, its detailed description is omitted.

As shown in FIG. 7A, data electrodes 10E and 10F are mounted such that their width increases gradually from a central portion of substrate 8 toward left and right peripheral portions. That is, the width of the plural data electrodes continuously increases toward the peripheral portions of substrate 8 from the central portion of substrate 8. The discharging characteristics of the discharge cells are made to vary gradually by designing the panel in this way. Therefore, deterioration of display quality by discontinuity of the brightness does not occur. Where the discharge cells are made different in width between the red, green, and blue colors, the width of the data electrodes should be increased toward the left and right peripheral portions from the central portion of the panel for each color.

Alternatively, data electrodes may be formed in such a way that 100 data electrodes 10E as counted from the left end of substrate 8 and 100 data electrodes 10E as counted from the right end may be wider than data electrodes 10F in a central portion of substrate 8. That is, among the plural data electrodes, data electrodes 10E disposed in peripheral portions of substrate 8 are wider than data electrodes 10F disposed in the central portion of substrate 8. For example, the width of data electrodes 10E is set to 130 μm. The width of data electrodes 10F is set to 100 μm.

Figure 7B:
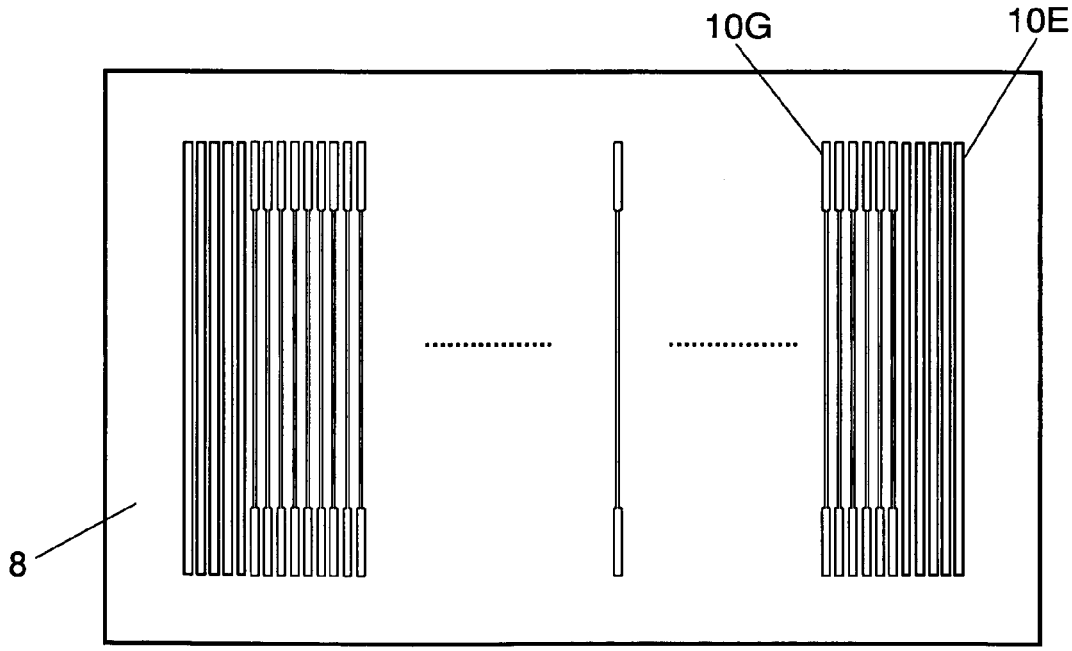
FIG. 7B is a plan view showing another shape of data electrodes of the PDP according to the embodiment 2 of the present invention.

The data electrodes may also be formed as shown in FIG. 7B. That is, data electrodes 10E in the peripheral portions disposed at the left and right sides of substrate 8 (plasma display panel) are wide. On the other hand, end portions located above and below data electrodes 10G disposed in the central portion of substrate 8 are wide in the same way as data electrodes 10 and 10D in the embodiment 1. In this way, among plural data electrodes 10E and 10G disposed on substrate 8, an end portion of at least one data electrode 10G should be wider than the central portion of data electrode 10G. The width of data electrodes 10E disposed in the peripheral portions of substrate 8 can be substantially identical with the width of end portions above and below data electrodes 10G disposed in the central portion of substrate 8.

Furthermore, the central portion of data electrodes 10G becomes preferably gradually narrower toward the central portion of substrate 8. Consequently, the same advantages as derived by the structure of FIG. 7A are obtained. In particular, in a 50-inch wide panel of 1366×768 pixels, the width of data electrodes 10E and the width of end portions of data electrodes 10G are set to 130 μm. The width of the central portion of data electrodes 10G adjacent to data electrodes 10E is set to 120 μm. The width of the central portion of data electrodes 10G located in the central portion of substrate 8 is set to 100 μm. The width of the central portion of data electrode 10G is made narrower continuously toward the central portion of substrate 8.

In this way, it is not always necessary to increase the width of data electrodes over the whole panel surface in order to stabilize writing discharging. In any of the above-described embodiments, the data electrodes are wider in peripheral portions of the panel and narrower around the center of the panel. The writing discharging can be stabilized and increases in data power can be suppressed by constructing the panel in this way.

It is to be understood that the regions in which the data electrodes are widened and their width are not limited to the above-described regions or numerical values. It is desired to optimally set them according to the characteristics of the discharge cells, the assembly accuracy of the plasma display panel, and other factors.

INDUSTRIAL APPLICABILITY

In the plasma display panel according to the present invention, increases in power consumption are suppressed if the panel is large in size and has high definition. Furthermore, stable writing discharging is enabled over the whole display screen. Consequently, the panel is useful for a display device.

The invention claimed is:

1. A plasma display panel driven by plural subfields forming one field, the subfields comprising:

a writing period during which writing discharging occurs in discharge cells to be displayed; and a sustaining period during which sustain discharging occurs in the discharging cells in which the writing discharging occurs during the writing period, the plasma display panel comprising:

a first substrate;

plural pairs of display electrodes, each pair consisting of a scanning electrode and a sustain electrode which are arranged parallel to each other on the first substrate;

a second substrate disposed opposite to the first substrate such that a discharge space is formed between the first substrate and the second substrate; and plural data electrodes disposed on the second substrate in a direction perpendicular to the display electrodes, the plural data electrodes including a middle portion having a first constant width, opposite end portions having a second constant width, and respective tapered portions extending from the middle portion to each of the end portions; and a plurality of barrier ribs such that the barrier ribs are arranged parallel to the data electrodes and the respective ones of the discharge cells are formed between adjacent two of the barrier ribs, wherein the second constant width is greater than the first constant width by a factor of more than 1.0 and not more than 1.5, the second constant width is not more than a half of a spacing between the adjacent two of the barrier ribs, respective ones of the discharge cells include a phosphor operable to emit a blue color, a phosphor operable to emit a red color, or a phosphor operable to emit a green color, and the opposite end portions of the data electrode corresponding to the respective one of the discharge cells including the phosphor operable to emit the blue color are wider than the opposite end portions of the data electrode corresponding to the respective one of the discharge cells including the phosphor operable to emit the red color.

2. A plasma display panel driven by plural subfields forming one field, the subfields comprising:

a writing period during which writing discharging occurs in discharge cells to be displayed; and a sustaining period during which sustain discharging occurs in the discharging cells in which the writing discharging occurs during the writing period, the plasma display panel comprising:

a first substrate;

plural pairs of display electrodes, each pair consisting of a scanning electrode and a sustain electrode which are arranged parallel to each other on the first substrate;

a second substrate disposed opposite to the first substrate such that a discharge space is formed between the first substrate and the second substrate;

a plurality of barrier ribs such that the barrier ribs are arranged parallel to the data electrodes and respective ones of the discharge cells are formed between adjacent two of the barrier ribs; and plural data electrodes disposed on the second substrate in a direction perpendicular to the display electrodes, the plural data electrodes including a middle portion having a first constant width, opposite end portions having a second constant width, and respective tapered portions extending from the middle portion to each of the end portions, wherein the second constant width is not more than a half of a spacing between the adjacent two of the barrier ribs, respective ones of the discharge cells include a phosphor operable to emit a blue color, a phosphor operable to emit a red color, or a phosphor operable to emit a green color, and the opposite end portions of the data electrode corresponding to the respective one of the discharge cells including the phosphor operable to emit the blue color are wider than the opposite end portions of the data electrode corresponding to the respective one of the discharge cells including the phosphor operable to emit the red color.

3. The plasma display panel of claim 2, wherein the data electrode increases in width continuously from the central portion of the second substrate toward the peripheral portion of the second substrate.

* * * * *